United States Patent [19]

Bakker

[11] Patent Number: 5,024,187

[45] Date of Patent: Jun. 18, 1991

[54] SYSTEM FOR AXIALLY LOCATING A CAMSHAFT

[75] Inventor: Emile A. M. Bakker, Windsor, Netherlands

[73] Assignee: Chrysler Corporation, Highland Park, Mich.

[21] Appl. No.: 566,921

[22] Filed: Aug. 14, 1990

[51] Int. Cl.[5] ..... F02F 1/00; F01L 1/00

[52] U.S. Cl. ..... 123/193 H; 123/90.27

[58] Field of Search ..... 123/194 H, 193 CH, 193 R, 123/90.27, 90.39, 90.38; 384/434, 420, 440

[56] References Cited

U.S. PATENT DOCUMENTS

| | | | |
|---|---|---|---|
| Re. 32,582 | 1/1988 | Futakuch et al. | 123/90.27 |
| 1,335,515 | 3/1920 | Lombard . | |
| 3,289,658 | 12/1966 | Surorek, Sr. . | |
| 4,199,202 | 5/1980 | Maeda | 384/434 |
| 4,553,510 | 11/1985 | Yano et al. | 123/90.34 |
| 4,593,657 | 6/1986 | Aoi et al. | 123/90.6 |
| 4,621,597 | 11/1986 | Kawada et al. | 123/90.27 |
| 4,632,073 | 12/1986 | Futakuchi | 123/90.27 |
| 4,681,069 | 7/1987 | Honma | 123/90.27 |
| 4,754,729 | 7/1988 | Abe et al. | 123/90.34 |
| 4,777,842 | 10/1988 | Yamada | 123/90.27 |
| 4,823,747 | 5/1989 | Wagner et al. | 123/90.27 |
| 4,957,079 | 9/1990 | Nakatani et al. | 123/90.27 |

*Primary Examiner*—Andrew M. Dolinar
*Assistant Examiner*—M. Macy
*Attorney, Agent, or Firm*—Kenneth H. MacLean

[57] ABSTRACT

An improved vehicle internal combustion engine's overhead camshaft type cylinder head assembly having a camshaft with a pair of lobes closely spaced axially a precise distance and a camshaft bearing cap positioned between the spaced lobes with a width dimension corresponding to the precise distance so that axial movement of the camshaft is prohibited by the bearing cap.

5 Claims, 2 Drawing Sheets

SYSTEM FOR AXIALLY LOCATING A CAMSHAFT

BACKGROUND OF THE INVENTION

1. Field of the Invention

This application concerns an overhead camshaft type internal combustion engine for a vehicle. Specifically, the engine includes a cylinder head assembly supporting one or two camshafts which are mounted thereon for rotation in synchronization with the engines crankshaft. The camshaft is supported in a cylindrical bearing assembly including a detachable bearing cap normally secured to the cylinder head assembly by cap screws. A simple and efficient means is used to prevent the camshaft from moving in its axial direction. This is done by mounting a bearing cap between a pair of camshaft lobes, the width of the bearing cap is made to match the spacing between the pair of lobes so that the axial location of the camshaft is fixed.

2. Description of Related Art

U.S. Pat. No. 32,582 reissued to Futakuchi et al., dated Jan. 26, 1988, discloses a cylinder head assembly with a camshaft mounted thereon in bearings. Specifically, the camshaft 35 is provided with an enlarged cylindrical projection 46 located adjacent a cylinder head bearing surface 36 and bearing cap 37. The surface 36 and cap 37 are formed with a complimentary recess so that the projection 46 and these recesses will serve to provide thrust location for the camshaft 35.

U.S. Pat. Nos. 4,553,510; 4,593,657 and 4,632,073 disclose cylinder heads with camshafts utilizing a radially enlarged projection and a groove or recess formed in the structure to axially fix a camshaft. None of the above teach the simple but efficient use of a bearing cap with a precise width secured between accurately spaced cam lobes to fix the camshaft in the axial direction. Other U.S. Patents uncovered but not judged to be particularly relevant include: U.S. Pat. Nos. 1,335,515; 3,289,658; and 4,621,597.

SUMMARY OF THE INVENTION

This application discloses applicant's simple yet efficient construction of cylinder head and camshaft for an overhead camshaft type engine. Axial movements of the camshaft are desirably prevented by locating a precisely dimensioned bearing cap with a predetermined width between a pair of camshaft lobes whose spacing between adjacent side faces is precisely dimensioned to receive the bearing cap.

Therefore, an object of this invention is to provide a simple yet efficient overhead camshaft type cylinder head assembly utilizing a bearing cap to prevent axial movement of the camshaft by locating the cap closely between a pair of cam lobes, thus preventing axial shifting of the camshaft in either direction.

Another object of the invention is to provide a simple and efficient means of preventing axial movement of an overhead camshaft by forming a space between adjacent lobes so that a bearing cap with a width corresponding to the dimension of the space can be mounted.

Still further objects and advantages of the subject improved overhead type camshaft assembly will be more readily understood after a reading of the following detailed description of a preferred embodiment, reference being made to the drawings thereof, described below.

IN THE DRAWING

FIG. 1 is a planar view of the subject dual overhead cam type engine cylinder head assembly with the camshaft's axial location by means of a sized bearing cap between two cam lobes; and FIG. 2 is an elevational sectioned view of the cylinder head assembly taken along section line 2—2 in FIG. 1 and looking in the direction of the arrows; and FIG. 3 is an elevational sectioned view of the cylinder head assembly taken along section line 3—3 in FIG. 1 and looking in the direction of the arrows; and FIG. 3A is an enlarged view of the circled portion labeled 3A in FIG. 3; and FIG. 4 is an elevational sectioned view of the cylinder head assembly taken along section line 4—4 in FIG. 1 and looking in the direction of the arrows.

DETAILED DESCRIPTION OF A PREFERRED EMBODIMENT

Figure 1:
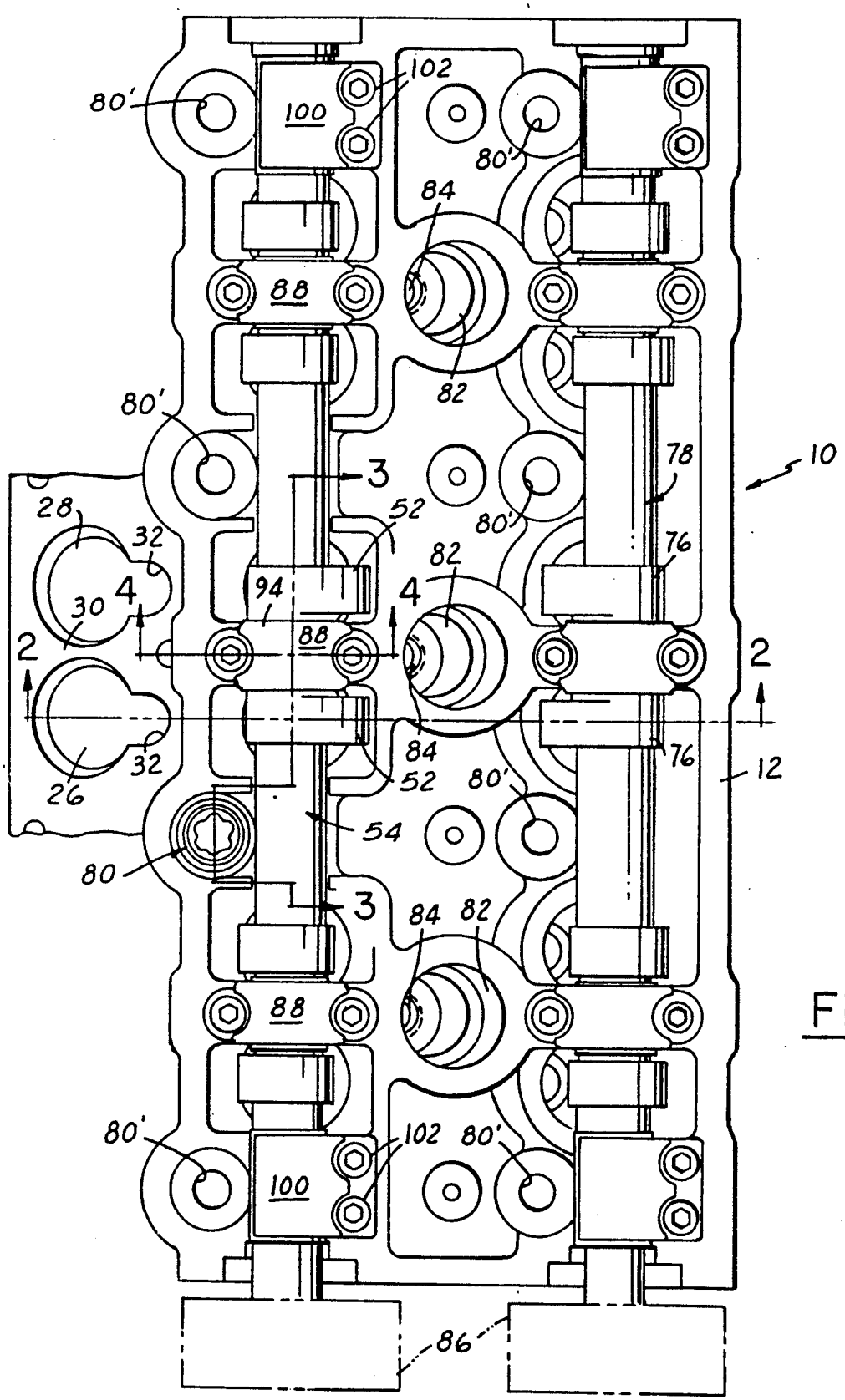
Figure 2:
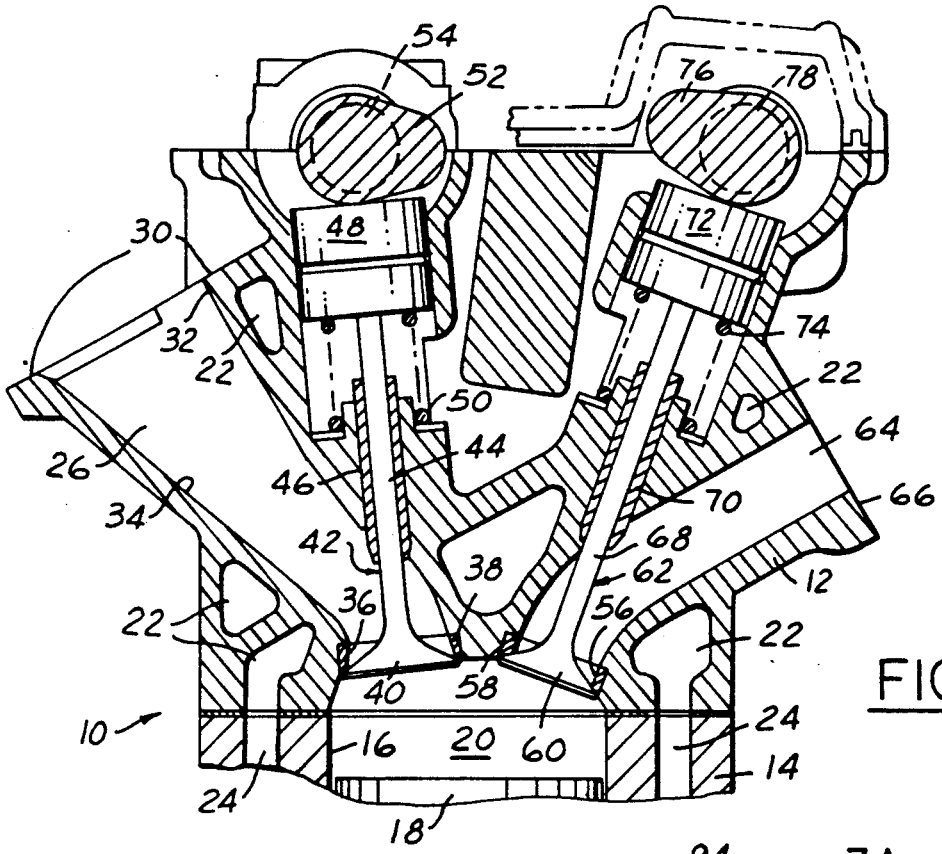

In FIGS. 1 and 2, an internal combustion engine 10 is partially illustrated. The engine 10 has a cylinder head portion 12 which is of the dual, overhead camshaft type. FIG. 2 partially shows an engine block 14 with a cylinder bore 16 and a piston 18. By examination of FIG. 1, it is obvious that the cylinder head 12 may be intended for either a three cylinder in line engine or is one bank of a six cylinder V-type engine. In such an engine, a variable volume combustion chamber 20 is formed by the cylinder head 12 and an associated cylinder bore 16 and piston 18. Of course, the fuel is combined with the air in the combustion chamber 20. To maintain the internal temperatures of the engine at an acceptable level, coolant passages 22, 24 are formed in the cylinder head 12 and block 14, respectively.

Other than for enclosing the combustion chambers 20, the cylinder head assembly is primarily for directing a fuel/air mixture to the combustion chambers 20 and for directing exhaust gases therefrom. The cylinder head 12 has two inlet passages 26, 28 formed therein for each combustion chamber 20 (in FIG. 1, only a pair of the passages are shown). The exterior surface 30 of the cylinder head 12 which surrounds the passages 26, 28 is adapted to have an intake manifold (not shown) attached thereto in a manner well known in the engine art. Each larger passage 26, 28 includes a smaller diameter opening portion 32 intercepting the larger passage 26, 28. The portions 32 are for the purpose of receiving a stream or spray of fuel from a fuel injector (not shown) which is mounted in the intake manifold.

Referring specifically to FIG. 2, fuel and air flow from the intake manifold past surface 30 and through the passage 26 to the combustion chamber 20. The wall 34 forming the intake passage 26 is made as smooth and as straight as possible so as not to offer unnecessary resistance to fluid flow. The passage 26 opens to the combustion chamber 20 through an inlet port 36 partially formed by an annular intake valve seat member 38 which is attached to the cylinder head 12. Flow through the port 36 is controlled by movements of an enlarged head portion 40 of a poppet type intake valve 42 shown in a closed operative position. Intake valve 42 has an elongated stem portion 44 which is supported by the cylinder block 12 within a tubular valve guide member 46 which allows the valve to reciprocate axially.

A hydraulic type valve lash adjuster assembly 48 contacts the upper end of the valve stem 44. A compression type coil spring 50 extends between the cylinder head 12 and the adjuster assembly 48 to normally maintain the intake valve in the illustrated closed position. As is known in the engine art, the valve 42 is moved downward against the force of the spring 50 to a more opened position by the action of a cam lobe 52 engaging the upper surface of the lash adjuster 48 as an associated intake camshaft 54 is rotated. More will be said of the camshaft 54 hereinafter.

Referring to FIG. 2, combusted fuel/air or exhaust gases are discharged from the chamber 20 through an exhaust port 56 formed by an annular exhaust valve seat member 58. A movable, enlarged head portion 60 of an exhaust valve member 62 controls the opening and closing of exhaust port 56. The exhaust then flows through an exhaust passage 64 in the cylinder head 12. The exterior surface 66 of the cylinder head 12 is adapted to attach to an exhaust manifold (not shown) as is well known in the engine art.

The exhaust valve 62 is similar in construction to the intake valve 42 and includes a stem portion 68 reciprocally supported in a valve guide member 70. The upper end portion of the valve 62 engages a lash adjuster 72 and the valve 62 is yieldably held in the illustrated closed operative position by a compression type coil spring 74. The valve 62 is moved toward a more opened position by the action of an exhaust cam lobe 76 on the upper surface of the adjuster assembly 72 as the exhaust camshaft 78 is rotated.

Figure 3:
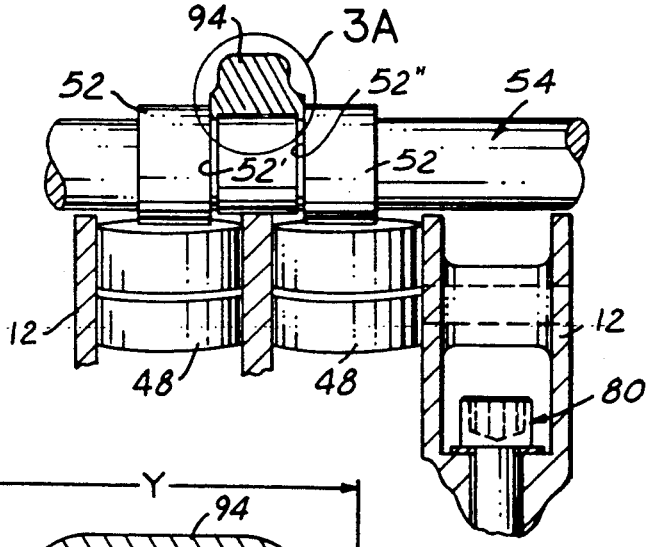

Referring specifically to FIG. 1, a top view of the cylinder head 12 reveals the elongated intake camshaft 54. Lobe 52 shown in FIG. 2 is located over the middle cylinder bore. Also shown is part of the elongated exhaust camshaft 78 with lobe 76 shown in FIG. 2. The cylinder head 12 itself is secured to the engine block 14 by a plurality of bolt fasteners 80, only one of which is illustrated in FIG. 1 but the locations for other fasteners is indicated by the numeral 80'. Perhaps the fastener 80 is best seen in FIG. 3.

Cylinder head assembly 12 also provides cylindrical recesses 82 into which spark plugs (not shown) are adapted to extend. Specifically, each recess 82 has a lower threaded opening 84 into which the spark plug is mounted.

The camshafts 54 and 78 are located with respect to the cylinder head 12 for rotation in synchronization with the rotation of the engine crankshaft. Specifically, the camshafts 54, 78 have enlarged input drives 86 attached to end portions as seen in FIG. 1. The input drives may take the form of gears adapted to engage other gears associated with the crankshaft. Alternately, the drives may take the form of toothed wheels adapted to engage a roller chain associated with the crankshaft. Both gears and chains have been used but are relatively noisy and expensive. A more modern camshaft drive means takes the form of toothed wheels or sprockets on the ends of the camshafts. A toothed rubber belt connects a toothed sprocket of the crankshaft and similarly toothed sprockets (86) on the ends of the ends of the camshafts 54 and 78.

Figure 4:
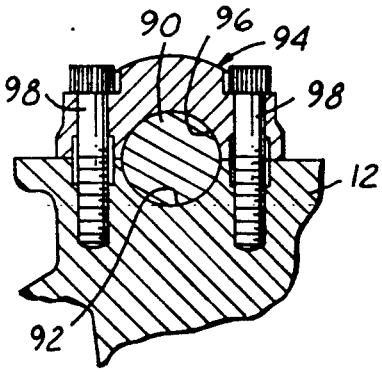

The camshafts 54 and 78 are mounted to the cylinder head assembly 12 and rotate in several bearing attachments which are generally identified by the numeral 88. These bearings 88 are located in line with each combustion chamber as indicated by alignment with a spark plug recess 82. A typical bearing is shown in FIG. 4 and includes a journal portion 90 of the camshaft which extends across a semi-cylindrical surface 90 formed in the cylinder head 12. A bearing cap 94 engages the cylinder head 12 and has a semi-cylindrical surface 96 which together with surface 92 encircle the journal portion 90. Bearing cap 94 is secured to the cylinder head 12 by a pair of cap screws 98. In addition to the bearing attachments 88, both end portions of the camshafts 54 and 78 are secured by partial bearing caps 100 which are attached to the cylinder head assembly 12 by a pair of cap screws 102. The screws 102 are both located on the same side of the camshaft so as not to interfere with the bolt fasteners 80 which are to extend through openings 80'.

As explained in the previous paragraph, the camshafts 54 and 78 are supported for rotation during operation of the engine. In addition to this rotation, there is a tendency for the camshafts to move in the axial direction unless restrained. Axial movements are undesirable. As previously understood from the discussion in the Background of the Invention, earlier engine designs provide relatively complicated (and expensive) structures to prevent axially movements of camshafts. The subject application discloses a quite simple yet effective and reliable means of preventing axial movements of the camshaft.

Figure 3A:
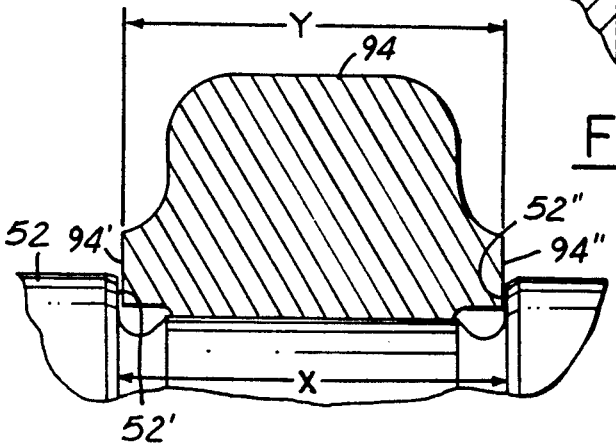

Reference is made to the intake camshaft 54 and lobes 52 shown in FIGS. 1, 3 and 3A to describe the axial retention structure of the subject application. However, the subject axial retention feature is just as applicable to the exhaust camshaft as the intake camshaft. In FIG. 1, the middle lobes 52 for the central combustion chamber are discussed although other pairs of lobes could perform the axial retention function. As shown in FIGS. 3 and 3A, the two lobes 52 have adjacent, facing end thrust surfaces 52' and 52". The end surfaces 52' and 52" are prepared (machined) so that the end surfaces are absolutely square to the axis of the camshaft and smooth. Also, the axial spacing or distance X between the surfaces 52' and 52" is precisely matched to a designated spacing.

A pair of side surfaces 94' and 94" of the bearing cap 94 are prepared (machined) so that these surfaces are absolutely normal to the axis of the cylindrical bearing for the camshaft as shown in FIG. 4. The dimension Y between these side surfaces 94' and 94" is matched to a precise design dimension. When bearing cap 94 is secured to the cylinder head assembly 12 between end surfaces 52' and 52", the resultant close fit serves to locate and axially fix the camshaft relative to the cylinder head assembly. This close fit is shown in FIG. 3A but the tolerance between the lobes and the cap is exaggerated. The design dimension Y between surfaces 94' and 94" is slightly less than the design dimension X between surfaces 52' and 52". This is to accommodate thermal expansion differences between the parts. In a proposed engine cylinder assembly according to this design, the dimension X between surfaces 52' and 52" is 19.98–20.02 millimeters. The dimension Y between surfaces 94' and 94" is 19.92–19.96 millimeters. This provides a minimum total clearance of between 0.02 and a maximum of 0.10 millimeters.

Although only a single embodiment of the invention has been illustrated and described in detail, modifications are certainly contemplated which would still be defined by the following claims which define the invention.

What is claimed is as follows:

1. In an internal combustion engine of the type having a cylinder head assembly with at least one rotatable camshaft mounted thereon, an improved camshaft retention arrangement, comprising: a pair of cam lobes closely spaced in the axial direction of the camshaft; each lobe having an end thrust surface extending in a plane normal to the camshaft axis, the end thrust surfaces facing one another and being spaced axially apart a precise dimension to define an axially extending gap; a bearing retainer cap attached to the cylinder head and occupying the gap formed between the end thrust surfaces, the retainer cap having a pair of side surfaces defining a width dimension therebetween, the retainer cap width being just sufficient to fill the gap whereby engagement of abutting end and side surfaces of the lobes and retainer respectively prevents axial movement of the camshaft with respect to the bearing cap and the cylinder head.

2. An improved cylinder head assembly for an internal combustion engine having an overhead camshaft which has a cylindrical journal portion mounted for rotation in a semi-cylindrical bearing surface formed in the cylinder head and an associated bearing cap member with a corresponding semi-cylindrical bearing surface formed therein, the improvement comprising: a pair of axially spaced apart cam lobes formed on the camshaft; each cam lobe having an end thrust surface formed normal to the axis of the camshaft, the end thrust surfaces facing one another and defining a precise gap in the axial direction therebetween; the bearing cap member having opposite side surfaces defining a width dimension of the bearing cap, the width dimension being substantially equal to the precise gap between the end thrust surfaces whereby engagement between an end thrust surface and an adjacent side surface of the cam lobe and bearing cap respectively prevents axial movement of the camshaft relative to the bearing cap and cylinder head.

3. The improved cylinder head assembly set forth in claim 2 in which said precise gap is slightly greater than the width of the bearing cap to accommodate relative thermal expansion between the bearing cap and the camshaft.

4. The improved cylinder head assembly set forth in claim 3 in which the clearance defined by subtracting said width from said gap is between 0.02 and 0.10 millimeters.

5. The improved cylinder head assembly set forth in claim 3 in which at room temperature the width of the bearing cap is between 19.92 and 19.96 millimeters, the precise gap is between 19.98 and 20.02 millimeters whereby the gap minus the width is at least 0.02 millimeters and no more than 0.10 millimeters.

* * * * *